United States Patent [19]

Wuthrich et al.

[11] 4,291,397

[45] Sep. 22, 1981

[54] MANUAL DATE ADVANCE MECHANISM FOR A WATCH

[75] Inventors: Paul Wuthrich, Watertown; Frank Mascia, Bristol, both of Conn.

[73] Assignee: Timex Corporation, Waterbury, Conn.

[21] Appl. No.: 85,168

[22] Filed: Oct. 15, 1979

[51] Int. Cl.[3] ..... G04B 19/24

[52] U.S. Cl. ..... 368/35; 368/38

[58] Field of Search ..... 58/5, 58, 85.5; 368/34, 368/35, 38, 185

[56] References Cited

U.S. PATENT DOCUMENTS

| | | | |
|---|---|---|---|
| 3,413,800 | 12/1968 | Dubois et al. | 368/35 |
| 3,659,413 | 5/1972 | Tanaka et al. | 58/58 |
| 3,732,687 | 5/1973 | Miyasaka et al. | 58/58 |

*Primary Examiner*—Vit W. Miska

*Attorney, Agent, or Firm*—William C. Crutcher

[57] ABSTRACT

A lever actuated by a manual pushbutton for advancing the date ring of a calendar watch so as to correct for months having less than 31 days. A special date change lever incorporates a tab actuated by the pushbutton, a first integral spring portion for biasing the lever to a normal rest position, a second integral spring portion for biasing an arm with a tab against the teeth of the date ring for advancing the date ring.

4 Claims, 3 Drawing Figures

MANUAL DATE ADVANCE MECHANISM FOR A WATCH

BACKGROUND OF THE INVENTION

This invention relates to a calendar watch with a date ring, and more particularly to an improved mechanism for manually correcting the date shown on the date ring in months having less than 31 days.

Calendar watches and day/date watches are known which incorporate wheels or rings showing the calendar date or day of the week through a small window or windows in the dial of the watch. These wheels or rings are periodically advanced by suitable wheels or levers actuated by the timekeeping mechanism. One such typical prior art device is fully described in U.S. Pat. No. 3,859,783 issued Jan. 14, 1975 to Paul Wuthrich, the present inventor, and assigned to the present assignee. The Wuthrich patent, which is incorporated herein by reference, includes a wheel with upstanding tabs driving both the day dial and the date ring.

A problem encountered in calendar watches with rings having 31 days on the ring is that it is necessary at the end of a month having fewer than 31 days to correct or manually advance the date ring. The date correction mechanism should preferably be simple and fast to operate, but constructed so that it does not interfere with the normal day-to-day date advancing mechanism. Many such arrangements have been shown over the years in the prior art, the following list of patents illustrating mechanisms which are exemplary of the prior art and not intended to be all-inclusive:

| U.S. Pat. No. | Inventor | Issue Date |
|---|---|---|
| 3,597,917 | Odagiri | August 10, 1971 |
| 3,645,086 | Niznik | February 29, 1972 |
| 3,659,413 | Tanaka et al | May 2, 1972 |
| 3,683,614 | Komiyama | August 15, 1972 |
| 4,060,977 | Rochat | December 6, 1977 |
| 4,109,458 | Suzuki et al | August 29, 1978 |
| 2,456,122 | Guilden | December 14, 1948 |

Some of the foregoing patents illustrate extremely complicated mechanisms. Others effect the date advance during the manual actuation part of the cycle with the actuator being returned by a spring. This lends itself to the possibility of damage by overenthusiastic actuation of the mechanism. It is more desirable that the advancing step be under the control of a uniform spring return mechanism.

One calendar correction mechanism of this latter type which effects a date advance during the spring-return portion of the cycle rather than during the actuator portion of the cycle is illustrated in U.S. Pat. No. 3,413,800—Dubois et al issued Dec. 3, 1968. The Dubois et al patent incorporates a pivotable date advance lever, one end of which is actuated by a separate lever and having a separate spring member to hold the date advance lever in the proper position. It would be desirable to reduce the complexity of a calendar correction mechanism by incorporating a single piece date advance lever with integral spring biasing portions and having a very simple construction.

Accordingly, one object of the present invention is to provide an improved manual date advance mechanism for a watch which provides for rapid advance of the date ring under control of a spring action after release of a manual actuator.

Another object of the invention is to provide an improved date change lever for such a mechanism having integral spring portions and of simple construction.

DRAWINGS

The invention, both as to organization and method of practice, together with further objects and advantages thereof, will best be understood by reference to the following description taken in connection with the accompanying drawings, in which:

FIG. 1 is a fragmented plan view showing the date advance and correction mechanism for a calendar watch, looking toward the dial side of the watch, FIGS. 2 and 3 are simplified plan views as viewed from the back side of the mechanism, with case removed, showing the improved date change lever in the "rest" position and in the "operating" position respectively.

SUMMARY OF THE INVENTION

Briefly stated, the invention is practiced by providing in a calendar watch of the type having a date advance mechanism for a date ring with detent spring, the improvement comprising a date change lever having a section cooperating with a manual actuator, a first integral spring portion for biasing the lever to a "rest" position, an arm with a tab for engaging the teeth of the date ring, and a second integral spring member for holding the actuator tab engaged with the date ring as the first integral spring portion returns the lever to the rest position and advances the date ring.

DESCRIPTION OF THE PREFERRED EMBODIMENT

Figure 1:
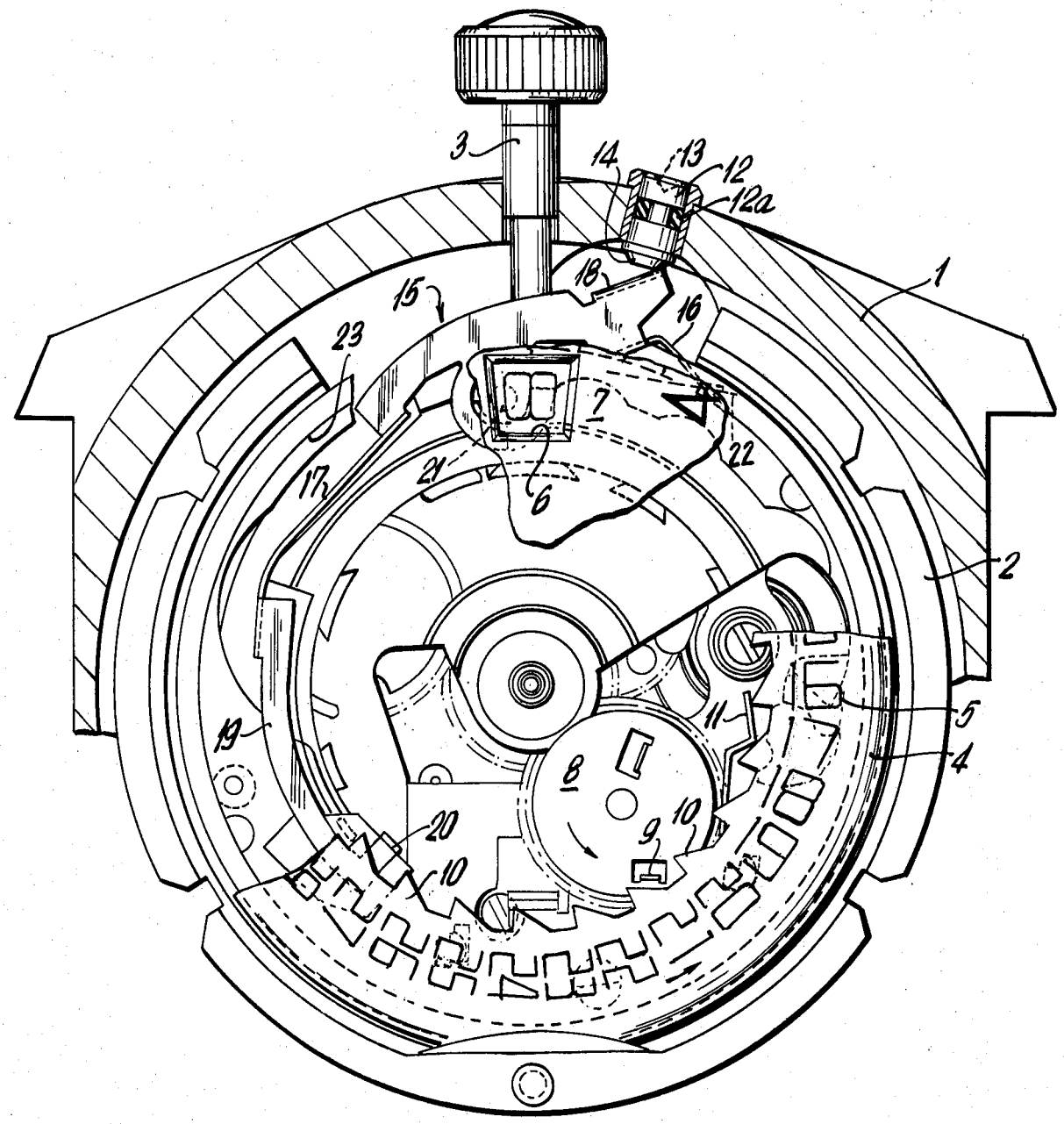

Referring to FIG. 1 of the drawing, the operative portions of a wristwatch which are relevant to the present invention, include a bezel 1 which is part of the watch case surrounding and containing a day/date frame 2. Frame 2 is usually a separate subassembly fitted to a conventional watch to convert it to a day/date or calendar watch. The conventional portions of the watch mechanism are not shown, but they include a stem and crown assembly 3 projecting through the bezel.

A date ring 4 is rotatably mounted in the frame 2 and has date-indicating indicia 5 printed thereon which are viewable through a window 6 in the watch dial 7. The watch may also include a day wheel (not shown) which has indicia printed thereon for the days of the week. The date ring and the day wheel are periodically advanced by a day/date advancing wheel 8 rotated by the conventional watch mechanism. The day/date advancing wheel advances the date ring periodically by means of an upstanding tab 9 which cooperates with internal teeth 10 on the date ring. The date ring is held in position after it has been periodically rotatably advanced, by means of a spring detent member 11. There are 31 internal teeth 10 and the day/date wheel 8 advances once each 24 hours to advance the calendar date by one number. The foregoing mechanism is fully and completely described in the aforementioned Wuthrich U.S. Pat. No. 3,859,783.

In months having fewer than 31 days, it is necessary to correct the calendar reading by advancing the date ring by one position for months having 30 days and advancing it three positions at the end of February. In accordance with the present invention, the means for manually correcting or advancing the position of the date ring comprises the following improvements.

A manual actuator comprises a pushbutton 12 slideably disposed in the bezel with a suitable sealing gasket 12*a*. Pushbutton 12 has a recessed head 13 disposed outside the watch bezel for operation with a pointed instrument such as a stylus or ball point pen so that it will not be inadvertently actuated. Pushbutton 12 also includes an actuating portion 14 which is movable inwardly with respect to the frame 2 when the pushbutton is actuated.

In accordance with the present invention, a date change lever shown generally as 15 is pivotably mounted on frame 2. The operative portions of the date change lever include the first integral spring portion 16, a second integral spring portion 17, a section 18 providing a contact area receiving the actuating end of the pushbutton, and an integral arm 19 terminating in tab 20.

Tab 20 is disposed so that when the date change lever 15 is a "rest" position it does not interfere with normal periodic rotation of the date ring, since there is a clearance between tab 20 and the internal teeth 10 of the date ring.

The day/date change lever 15 is pivoted on a mounting comprising pin 21 held in the frame 2. The first integral spring portion 16 has a free end providing a first contact area cooperating with a wall 22 of the frame. The second integral spring portion 17 is free to move toward internal wall 23 and is springy in a radial direction. The integral arm 19 preferably is formed as an extension of the integral spring portion 17. Tab portion 20 is formed perpendicular to both arm 19 and spring 17. Equivalent means for mounting the lever and providing contact portions for the spring parts of the lever will be apparent to those skilled in the art without departing from the scope of the present invention.

OPERATION

Figure 2:
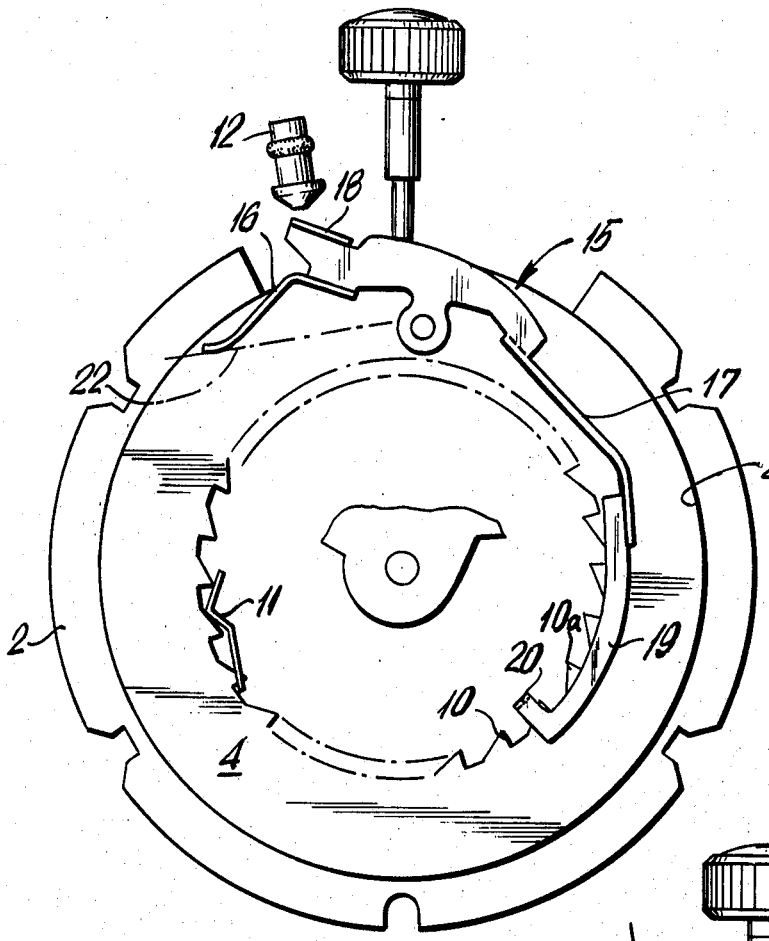
Figure 3:
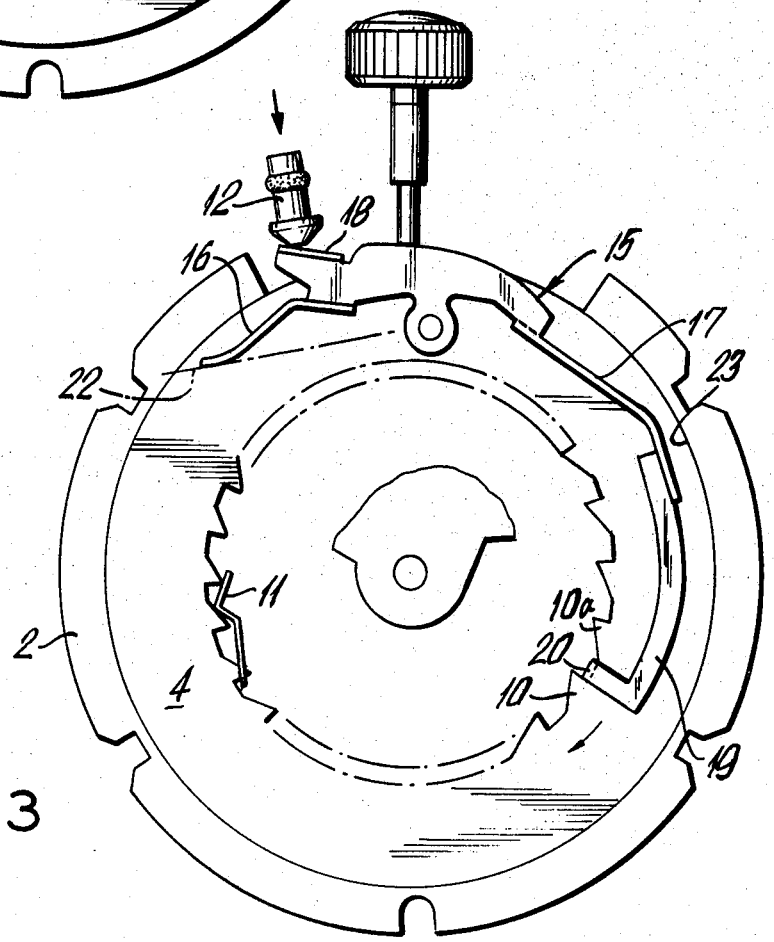

Referring to the simplified views of FIGS. 2 and 3 shown from the back side of the watch, the operation of the invention will be apparent. FIG. 2 shows the date change lever 15 in the "rest" position, while FIG. 3 shows the lever in its biased or "operating" position.

In FIG. 2, the lever is normally held in "rest" position by the first integral spring portion 16 cooperating with frame pin 22 to hold lever 15 rotated clockwise so that tab 20 misses the teeth 10 of date ring 4.

Pushing actuator button 12 rotates the lever counterclockwise against the spring portion 16 which is relatively stiff so that continued rotation biases the lever to cause it to return the lever when the pushbutton is released.

Rotation of the lever causes tab 20 to move downward and to the right to engage the date ring in the valley between two of the teeth 10. Continued movement causes the second integral spring portion 17 to flex so that the tab 20 will slide over tooth 10*a* and snap into the next valley. The spring portion 17 is relatively weak and springy and permits overtravel of the actuator button without damage to the date ring.

Upon release of the actuator button 12, the second spring member 17 holds tab 20 engaged with the date ring, while spring 16 rotates the lever clockwise and causes the date to advance by one position. When the pressure is sufficiently relieved on spring member 17, tab 20 springs clear of the date ring teeth and returns to the position shown in FIG. 2. Repeated actuation of the manual actuator causes repetitive advancing of the date ring in an expeditious manner.

Thus there has been shown an improved manual date correction mechanism for a calendar watch which provides in a single lever all of the elements necessary to advance the date ring while not interfering with normal operation of the normal periodic date advancing mechanism of the watch.

While there has been disclosed what is considered herein to be the preferred embodiment of the invention, other modifications will occur to those skilled in the art, and it is desired to include in the appended claims all such modifications as fall within the true spirit and scope of the invention.

What is claimed is:

1. In a calendar watch of the type having a frame, a date ring with internal teeth rotatably mounted in said frame, means for periodically rotatably advancing said date ring, and spring detent means for holding the date ring in position when advanced, the improvement comprising:

a manual actuator disposed adjacent said frame and having a portion movable with respect to the frame, and a date change lever pivotably mounted on the frame, said lever including integral therewith: a first integral spring portion having a first contact area cooperating with said frame and biasing the lever to a rest position, a second contact area defined by said lever disposed to cooperate with the movable portion of said actuator to cause said lever to pivot, an integral arm having a tab portion adapted to cooperate with said date ring internal teeth when the lever is pivoted toward an operating position, and a second integral spring portion adapted to flex when said integral arm and tab are pivoted toward an operating position, said lever being arranged to move said tab into engagement with said internal teeth when the actuator is operated, said second spring portion being arranged to hold the tab in position as the first spring portion returns the lever to rest position whereby the date ring is rotatably advanced.

2. The combination according to claim 1, wherein said date change lever defines a pivot mounting, and wherein said first integral spring portion is a relatively stiff spring member freely extending on one side of the pivot mounting of the lever, and wherein said second integral spring portion is a relatively weak spring member interposed between the pivot mounting of the lever and said integral arm of the lever.

3. The combination according to claim 1, wherein said integral arm and tab portion are an extension of said second integral spring portion.

4. The combination according to claim 1 wherein said date change lever defines a pivot mounting, an actuator platform disposed on one side thereof, said first integral spring extending beyond on the same side as the actuator platform, said second integral spring portion extending on the other side of the lever pivot mounting, said integral arm formed as an extension perpendicular to the second integral spring portion, and said tab portion formed perpendicular to the integral arm.

* * * * *